US005513826A

United States Patent [19]

Lebaron

[11] Patent Number: 5,513,826

[45] Date of Patent: May 7, 1996

[54] SUPPORT APPARATUS FOR STACKING AND CUTTING ROOF SHEATHING

[76] Inventor: Alden R. Lebaron, 5858 Menorca Dr., San Diego, Calif. 92142

[21] Appl. No.: 371,779

[22] Filed: Jan. 12, 1995

[51] Int. Cl.[6] ..... A47G 29/02

[52] U.S. Cl. ..... 248/237; 182/45

[58] Field of Search ..... 248/237; 182/45, 182/38, 142, 152

[56] References Cited

U.S. PATENT DOCUMENTS

| | | | |
|---|---|---|---|
| 1,010,994 | 12/1911 | White | 248/237 |
| 1,074,382 | 9/1913 | Richards | 248/237 |
| 1,187,369 | 6/1916 | Neville | 248/237 |
| 1,301,533 | 4/1919 | Anderson | 248/237 |
| 1,580,027 | 4/1926 | Fagg . | |
| 1,661,192 | 3/1928 | Nelson | 248/237 |
| 4,048,924 | 9/1977 | Wibben | 182/38 X |
| 4,946,123 | 8/1990 | Albert | 182/45 X |
| 5,067,586 | 11/1991 | Myers | 182/82 X |
| 5,113,971 | 5/1992 | Violet | 182/45 |
| 5,165,642 | 11/1992 | Rihally | 248/237 |
| 5,370,202 | 12/1994 | Nichols | 248/237 X |

*Primary Examiner*—J. Franklin Foss

*Attorney, Agent, or Firm*—Brown, Martin, Haller & McClain

[57] ABSTRACT

A support assembly for supporting sheathing material sheets during a roofing or re-roofing operation has two brackets for securing at spaced locations on a roof frame. Each bracket has a base member for lying along the incline of the roof, a hook at one, upper end of the base member for hooking over the ridgepole, roof frame member or existing roof sheathing, and an upright member projecting upwardly at the opposite, lower end of the base member for providing a support for storing and cutting a stack of sheathing sheets placed over the base members of the two brackets.

18 Claims, 2 Drawing Sheets

SUPPORT APPARATUS FOR STACKING AND CUTTING ROOF SHEATHING

BACKGROUND OF THE INVENTION

This invention relates generally to roofing or roof construction in building a new roof on a new building, in remodeling, or in repairing or replacing an existing roof, and is particularly concerned with a support apparatus for use in roofing to support a stack of roof sheathing material such as plywood and enabling a safe cutting platform.

In roof construction, roof sheathing panels or sheets of plywood or the like are secured over the roof rafters or frame to form a base for roof finish materials such as shingles or wood shakes. In the field of roof construction, whether it has been of new construction or of a re-roofing nature, there has always been a problem in placing multiple sheets of sheathing material on an incline while affording an individual a safe working area for cutting and attaching the sheets to the underlying rafters. A stack of sheathing sheets sufficient to cover a typical inclined roof surface will be extremely heavy, and such a stack cannot be safely placed on an incline without support. Up to now, one solution to this problem has been to leave the plywood sheets stacked on the ground, and for a person on the ground to pass them up one at a time to the person working on the roof. This is clearly inefficient. Another alternative technique has been to fasten short length wooden 2" by 4" posts to the side of rafters with nails, so that the posts project upwardly from the rafters, and to stack the plywood behind these posts. This is not particularly safe, and if the posts should give way any person on the roof beneath the stack will be swept off the roof and may be seriously injured, and persons on the ground will also be at risk.

SUMMARY OF THE INVENTION

It is an object of the present invention to provide a new and improved support assembly for use in roof sheathing.

According to the present invention, a support apparatus is provided which comprises a pair of support brackets, each bracket comprising an elongate bar or base member for placing over a roof framework to extend down along the incline of the roof, the bar having opposite first and second ends, at least one hook member projecting downwardly at an angle from a location at or adjacent the first end of the bar for hooking over a roof ridge, roof frame member or existing sheet of roof sheathing adjacent one side of a roof rafter, and an upright support arm projecting upwardly from the second end of the bar in the opposite direction to the hook member for supporting sheathing panels or sheets stacked on the elongate bar. The hook member has at least one opening for receiving a fastener such as a nail for securing the hook member to the rafter.

Preferably a pair of spaced hook members project downwardly from the first end of the base member for engaging on opposite sides of a rafter and fastening to the rafter for added security and support strength.

The support members are secured at two spaced positions on the roof framework in horizontal alignment, so that the spaced support bars and upright support arms form a support platform for a stack of plywood or other roof sheathing material during a roof sheathing operation. The brackets also provide a cutting platform for cutting the plywood sheets to the desired dimensions.

Preferably, each of the hook members has at least two openings for receiving fasteners such as nails for extending transversely through the respective hook member openings and into the rafter encompassed by the hook members. The openings in one hook member are offset from those in the other hook member. With this arrangement, the fasteners or nails extend in a direction transverse to the load on the bracket, reducing the risk of the bracket failing or coming free from the roof.

Preferably, a hook is provided on each of the upright members, and can be used for holding tools such as saws or the like when not in use, or for supporting a fan for blowing sawdust debris away from an individual while cutting plywood sheets on a stack supported by the brackets. The brackets therefore act as a support and cutting platform for plywood or other sheathing sheets.

In a preferred embodiment of the invention, each bracket also includes a leg extending away from the second end of the base member and co-planar with the base member, with a hook at the free end of the leg for receiving one end of a foot board for providing a foot support to an individual while cutting plywood sheets supported by the brackets. The hook may have an opening or eye for receiving a suitable clamp or the like of a safety harness for safety of an individual against falls during a roofing operation. The base member, hook members, upright member and leg are preferably all formed from steel bars which are suitably welded together to provide a one-piece integral bracket.

Although the brackets are relatively lightweight and easy to lift onto a roof and secure in a desired position, because of their design and the manner of fastening the brackets to the roof, they can support a relatively heavy weight of sheathing material. Each bracket is of simple, one-piece construction with no moving parts, and is easy to secure to an underlying roof structure. Thus, sheathing material as needed for a roofing operation can be stacked and supported on the roof, where it is immediately available for use, rather than having to lift sheets one at a time from the ground onto the roof and fasten them in place. The front forks or hooks engage on opposite sides of a roof rafter and are fastened to the rafter by fasteners such as screws which extend transverse to the load direction. This helps to resist the tendency for the bracket to lift away from the roof at its upper end under the weight of the pile of plywood bearing against the rear end. The height of the upright members is selected according to the weight of sheathing material which can be safely supported. The brackets can easily be moved to a new location as necessary during roofing. The support assembly is efficient, easy to use, and safer than previous techniques for supporting sheathing material on a roof.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
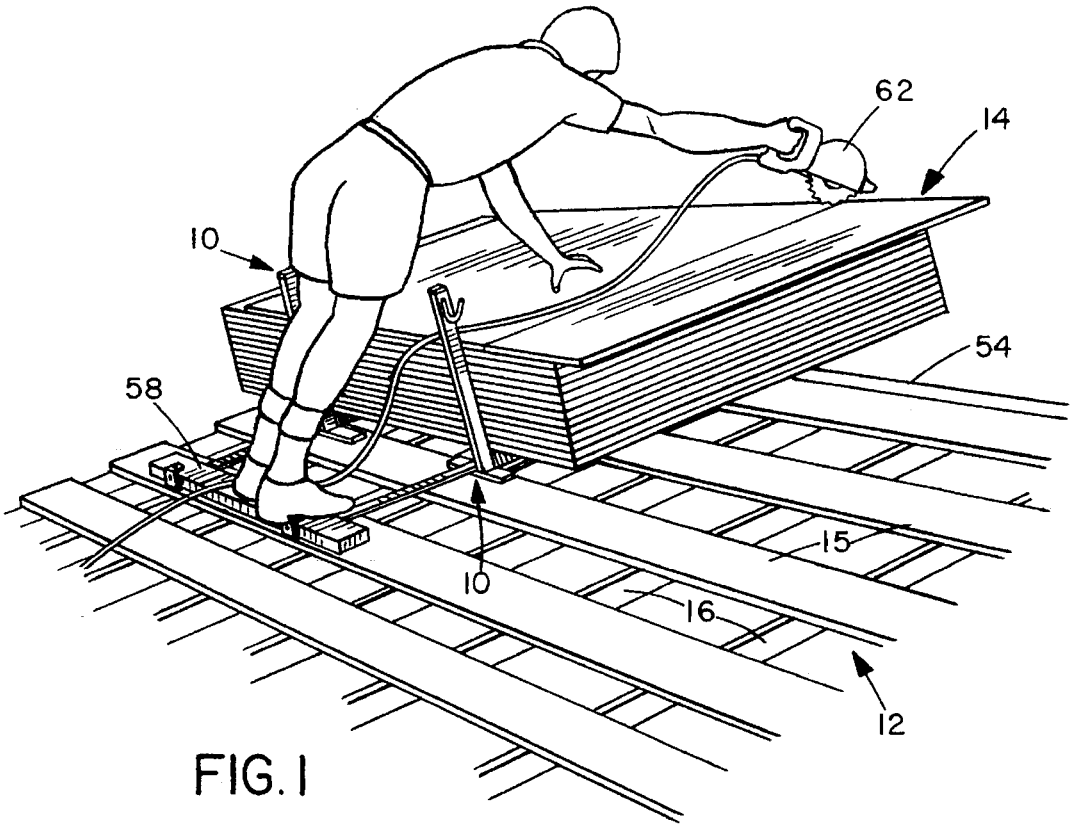
FIG. 1 illustrates a roofing operation using a support apparatus according to a preferred embodiment of the invention with a pair of support units holding a stack of plywood.

FIG. 1 of the drawings illustrates a support assembly according to a preferred embodiment of the invention in use during a roofing operation. The support assembly basically comprises a pair of identical support units or brackets 10, one of which is illustrated in more detail in FIGS. 2 and 3, which can be detachably secured over a roofing structure 12 in order to support a stack 14 of plywood or other roof sheathing material. FIG. 4 illustrates an alternative mounting of one of the support units 10 over a frame unit 15 and roof rafter 16 during a roofing or re-roofing operation, as will be described in more detail below.

Figure 2:
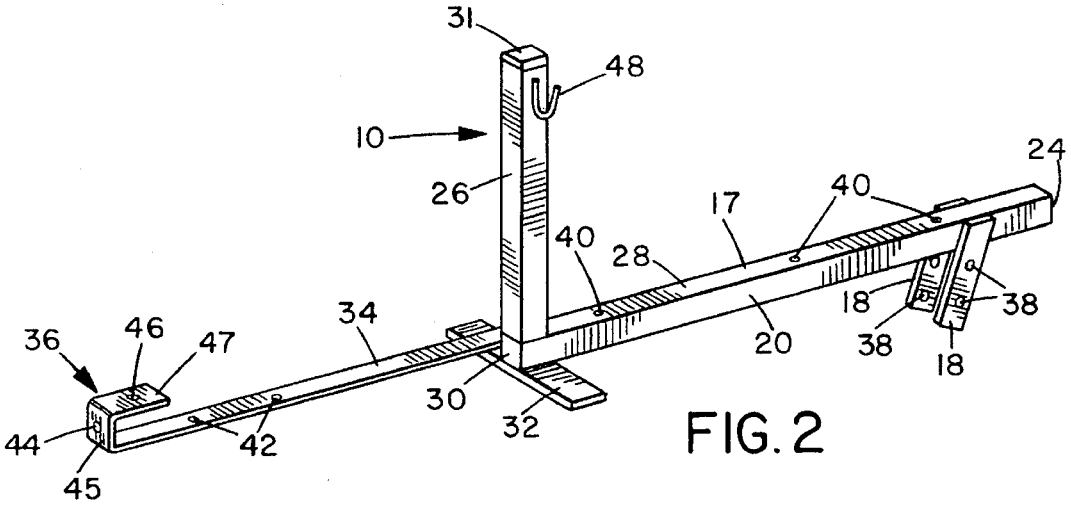
FIG. 2 is a pictorial view of a support unit.
Figure 3:
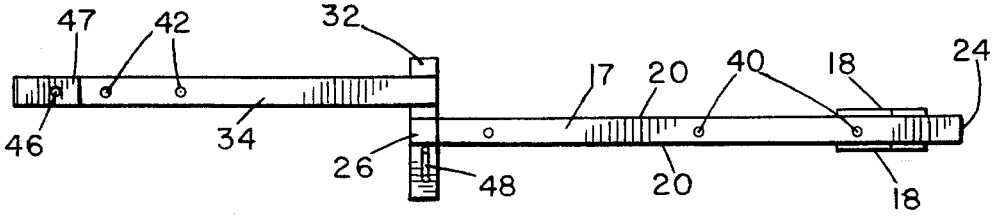
FIG. 3 is a top plan view of the support unit.
Figure 4:
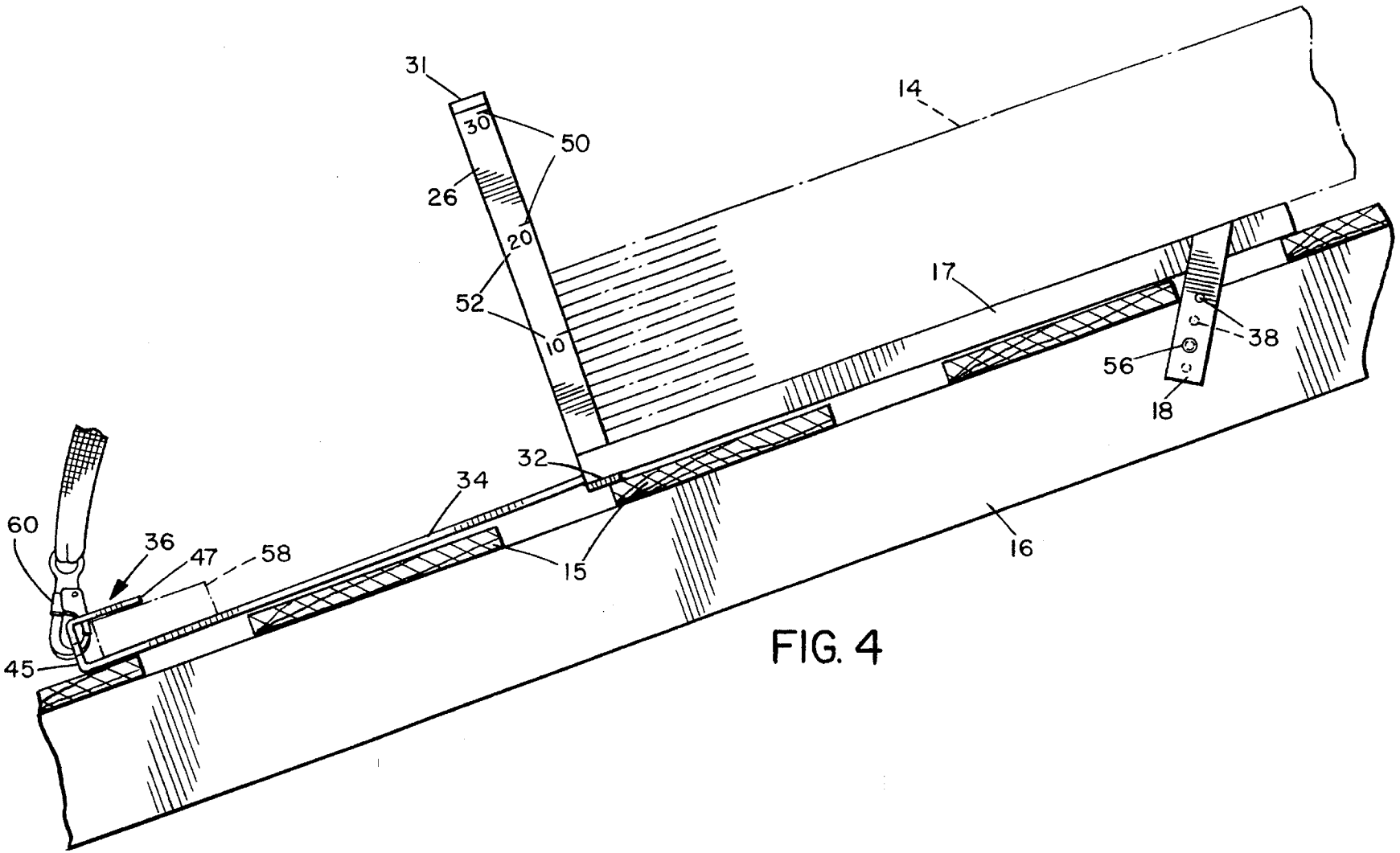
FIG. 4 is an enlarged side view of the support unit, showing the attachment to a roof structure.

As best illustrated in FIGS. 2 and 3, each support unit 10 basically comprises an elongate bar or base member 17 of suitable strength material such as steel which has a pair of flat hook or fork members 18 projecting downwardly from its opposite side faces 20 adjacent a first end 24 of the bar 17, and an upright support bar 26 projecting upwardly from its upper face 28 at the opposite end 30 of the bar. The base bar and upright support bar are preferably of square section, steel tubing with end caps at their free ends. The two hook members may be of plate steel, and the bars and hook members are suitably welded together. Hook members 18 project downwardly at an acute angle of less than 90° to the base bar or member 17. The angle is preferably of the order of 30°.

A relatively short cross bar or plate 32 is welded across the end 30 of the bar, and an elongate, flat leg member 34 is welded at one end to cross plate 32 so as to extend away from the base bar 17 in a direction parallel to the bar. The free end of leg member 34 is shaped to form a square section hook 36 facing towards upright bar 26. Cross plate 32 and leg member 34 are also preferably of steel or similar strength metal. In the preferred embodiment of the invention, the entire support unit 10 is of welded steel, but the unit may alternatively be made of other high strength metals or materials, such as aluminum or fiberglass.

Each of the flat hook members 18 has at least two spaced openings 38, with the openings 38 in one hook member being offset from those in the other hook member, as best illustrated in FIG. 4. The hook members preferably depend downwardly at least 5" from the base bar, and the openings 38 are preferably spaced around 2" apart. The base bar may be of the order of 30" in length, and has a series of spaced through holes 40 which extend through the upper and lower walls of the channel. The base bar and upright support bar are preferably of 1½" square tube. The hook members 18 are spaced around 1⅝" apart, which is equal to the nominal thickness of a roof rafter, so that they will fit tightly against opposite sides of a rafter. Preferably, the front hook members or forks 18 are located at a spacing of around 24 " from the upright member 26. Through holes 42 are preferably also provided in the flat portion of leg member 34. An enlarged hole 44 is provided in the upright portion 45 of the hook 36 at the end of leg member 34, while a further hole 46 is provided in the upper portion 47 of hook 36, as best illustrated in FIG. 2. Leg member 34 preferably extends around 24 " from the end 30 of base member 17.

The upright member 26 is no more than 15 " in height, and preferably has a hook 48 adjacent its upper end. Preferably, a scale is provided on one side face of upright member 26 with spaced scale marks or lines 50 associated with numbers 52 indicating the number of sheets of plywood supported, as illustrated in FIG. 4. The height of the upright member is arranged so that the support assembly can safely support a stack of plywood up to the top of the upright member. A set of support units 10 mounted as in FIG. 1 or FIG. 4 will hold a stack of up to 30 sheets of plywood or approximately 2,000 lbs of sheathing material if fully loaded to the top of the upright members 26. The upright members may be made shorter for use on a relatively steep roof, although a height of 15 " will ensure that the structure is not overloaded for roof pitches up to around 11. Fewer sheets of plywood should be stacked for roof pitches of 12 to 15, and support units with shorter upright members 26 may be provided for use with roof pitches in this range or higher.

Use of the support units 10 in supporting stacks of plywood on a roof during a new roofing, re-roofing, or roof repair operation will now be described in more detail. A pair of support units is first secured at suitable spaced apart locations on a roof structure 12 with the base bars extending down along the incline of the roof, by hooking the front forks or hook members 18 of each support unit over a suitable horizontal or cross member of the roof structure, which may be the ridgepole 54 at the top of the roof as in FIG. 1, or a horizontal cross member 15 of the roof frame as in FIG. 4, or an existing sheet of plywood sheathing in a re-roofing or roof repair operation. The hook members or forks 18 are positioned so that they engage on opposite sides of one of the vertical roof rafters 16, as best illustrated in FIG. 4. The spacing between the support units will be less than the length of the plywood sheeting to be supported, as illustrated in FIG. 1. Each hook member or fork 18 can be secured to the underlying rafter 16 by one or more hanger nails 56 extending through one or both openings 38, as illustrated in FIG. 4, and through the rafter. The offset between the openings 38 in the two forks ensures that the forks can be secured to the rafter by staggered nails 56 extending in opposite directions through the respective fork and the rafter. The hook members or forks 18 are designed to encompass a roof rafter of any standard dimensions, from a 2" by 4" rafter of a truss roof system to a 2" by 12" rafter.

If desired for additional security, each unit may be additionally secured to the underlying roof structure by nails extending through one or more of the openings 40 and 42. The hooks 36 at the lower ends of leg members 34 may be used to support the opposite ends of a foot board 58, suitably a 2" by 4" or 2" by 6" length of wood, as illustrated in FIGS. 1 and 4. Board 58 may be secured in position by nails passing through openings 46 at the top of the two hooks 36, if desired. Openings 44 may be used for securing the snap hook or clasp 60 at the end of a conventional safety harness to one of the support units, if desired, as illustrated in FIG. 4. Such safety harnesses are used by construction workers in certain hazardous roofing situations, such as very steep roof structures or at heights requiring such additional safety precautions, for example.

Once the two spaced support units have been secured to the roof structure at an appropriate location, the two base bars 17 and upright members 26 together form a strong and stable support platform for a stack of plywood sheets of sheathing material, as illustrated in FIGS. 1 and 4. An appropriate number of sheets of material, depending on the area of roof to be covered and up to a maximum of 30 to prevent overloading, can then be stacked on top of base bars 17 with the edges of the sheets resting against upright members 26. This ensures that the sheets will not slide off the bracket system. The sheets are then readily available in the area being worked and may be taken one at a time from the stack and secured on top of the roof structure to form a base for roof finish material.

The support structure may also be used as a cutting platform for cutting the stacked sheets to an appropriate length with a suitable saw 62 or the like, as illustrated in FIG. 1, by a construction worker using the footboard 58 for support. The hooks 48 on the upright members may be used for safe storage of tools or other items while not in use. For example, an air blower may be hooked over one of the hooks 48 and directed over the cutting area during cutting, to keep the area free from loose debris. Cutting and other tools may be hooked over the hooks 48 while not in use.

The support units 10 may be used either in new roof construction or in re-roofing or roof repair. The units 10 may be hooked over the ridgepole or any other cross member of the roof structure, such as existing skip sheathing in a re-roofing application. In the latter case, the existing skip sheathing will help to distribute weight out over multiple rafters. In new construction, sheets of plywood may be applied at the eave area and nailed off, and a pair of support units may then be hooked over the plywood sheets to encompass two rafters as above.

The support units are extremely easy to mount on a roof, and will help to make a roofing operation more efficient and safe. Once properly mounted, the support units together provide an extremely strong support platform for carrying loads of up to 2,000 lbs of plywood sheets on an inclined roof and also provide a stable and safe cutting platform for such plywood. The front forks or hooks sweep back at an angle to ensure that the platform cannot easily pull up at its front end under applied load. The front forks or hooks are secured to a rafter by at least two hanger nails extending transverse to the load direction, so that they cannot be pulled out under heavy loads, but would have to be sheared off completely before the system could fail.

The legs extending from the platform provided by the base and upright members provide a mount for a foot board for additional safety. An adjustable bracket may be provided to allow the foot board to be supported in a generally horizontal orientation relative to the ground, for steeply pitched roofs. However, this will not normally be required.

The support units are relatively lightweight and of one piece construction, making them easy and efficient to install and move to a new location on a roof during progress of a roofing job. The units provide a securing system for a foot hold to reduce the risk of falls when cutting materials, as well as an anchor point for a safety harness if needed. The units can also be stacked readily for storage when not in use.

Although a preferred embodiment of the invention has been described above by way of example only, it will be understood by those skilled in the field that modifications may be made to the disclosed embodiment without departing from the scope of the invention, which is defined by the appended claims.

I claim:

1. A support assembly for roof sheathing material, comprising:

a pair of support brackets for securing to a roof frame in spaced apart locations to provide a support platform for a stack of roof sheathing sheets;

each bracket comprising an elongate base member for placing flat on a roof frame to extend along the incline of the roof, the base member having opposite first and second ends;

at least one hook member extending downwardly at an angle from a first location on the base member for hooking over a roof ridgepole, roof frame member or sheathing along one side of a rafter, the hook member having at least one opening for receiving a fastener for securing the hook member to the adjacent rafter; and an upright support member projecting upwardly from a second location on the base member spaced from the hook member, the support members together comprising means for supporting a stack of sheet material placed on the base members of both brackets.

2. The assembly as claimed in claim 1, wherein the hook member is located adjacent the first end of each base member.

3. The assembly as claimed in claim 2, wherein the support member is located at the second end of each base member.

4. The support assembly as claimed in claim 1, wherein each base member has opposite longitudinal sides and each bracket has a pair of spaced hook members projecting downwardly from opposite sides of the base member for engaging on opposite sides of a rafter, each hook member having at least one opening for receiving a fastener for extending through the hook member into the rafter.

5. The support assembly as claimed in claim 4, wherein the hook members extend at an angle of less than 90° to the base member.

6. The support assembly as claimed in claim 5, wherein the hook members extend at an angle of about 30° to the base member.

7. The support assembly as claimed in claim 4, wherein each hook member has at least two openings.

8. The support assembly as claimed in claim 7, wherein the openings in each hook member are offset from those in the other hook member.

9. The support assembly as claimed in claim 4, wherein each hook member comprises a flat bar lying in a plane perpendicular to said elongate base member.

10. A support assembly for roof sheathing material, comprising:

a pair of support brackets for securing to a roof frame in spaced apart locations to provide a support platform for a stack of roof sheathing sheets;

each bracket comprising an elongate base member for placing flat on a roof frame to extend along the incline of the roof, the base member having opposite first and second ends;

at least one hook member extending downwardly at an angle from a first location on the base member for hooking over a roof ridgepole, roof frame member or sheathing along one side of a rafter, the hook member having at least one opening for receiving a fastener for securing the hook member to the adjacent rafter;

an upright support member projecting upwardly from a second location on the base member spaced from the hook member, the support members together comprising means for supporting a stack of sheet material placed on the base members of both brackets; and each bracket including a flat leg projecting from the second end of the base member and co-planar with the base member for extending downwardly from the base member across the roof frame, the flat leg having a free end shaped to form a hook for supporting one end of a foot board extending between the legs to provide a foot support.

11. The support assembly as claimed in claim 10, wherein each hook has an opening for hooking on a safety harness for use by individuals when roofing.

12. The support assembly as claimed in claim 1, including a hook on said upright member for supporting items for use in roofing.

13. The support assembly as claimed in claim 1, wherein each bracket is of welded steel material.

14. The support assembly as claimed in claim 1, wherein each bracket is of aluminum.

15. The support assembly as claimed in claim 1, wherein each bracket is of fiberglass.

16. The assembly as claimed in claim 1, wherein the base member and upright support member are each of square section tubing material.

17. The assembly as claimed in claim 1, wherein the support brackets are separate members and comprise means for securing separately to a roof at any selected spacing to provide a support platform of variable width.

18. A support assembly for roof sheathing material, comprising:

a pair of support brackets for securing to a roof frame in spaced apart locations to provide a support platform for a stack of roof sheathing sheets;

each bracket comprising an elongate base member for placing flat on a roof frame to extend along the incline of the roof, the base member having opposite first and second ends;

at least one hook member extending downwardly at an angle from a first location on the base member for hooking over a roof ridgepole, roof frame member or sheathing along one side of a rafter, the hook member having at least one opening for receiving a fastener for securing the hook member to the adjacent rafter;

an upright support member projecting upwardly from a second location on the base member spaced from the hook member, the support members together comprising means for supporting a stack of sheet material placed on the base members of both brackets; and the upright member having a series of spaced numbers for indicating the number of sheets loaded on the brackets.

* * * * *